United States Patent [19]

Nakayama et al.

[11] 3,973,999

[45] Aug. 10, 1976

[54] METHOD FOR PRODUCING A HIGH TENSILE STRENGTH AND HIGH TOUGHNESS BEND PIPE

[75] Inventors: Masatoki Nakayama; Hajime Nakasugi, both of Kisarazu; Hiroshi Tamehiro, Kimitsu; Turugi Kimura, Kimitsu; Masanobu Yamaguti, Kimitsu, all of Japan

[73] Assignee: Nippon Steel Corporation, Tokyo, Japan

[22] Filed: July 11, 1975

[21] Appl. No.: 595,310

[30] Foreign Application Priority Data

July 11, 1974 Japan ..... 49-79623

[52] U.S. Cl. ..... 148/12 R; 148/12.4

[51] Int. Cl.[2] ..... C21D 9/08

[58] Field of Search ..... 148/12 R, 12 F, 12.4, 148/134, 143, 144, 145

[56] References Cited

UNITED STATES PATENTS

| | | | |
|---|---|---|---|
| 2,797,162 | 6/1957 | Korczynsky | 148/134 |
| 3,915,763 | 10/1975 | Jennings et al. | 148/145 |

*Primary Examiner*—W. Stallard

*Attorney, Agent, or Firm*—Wenderoth, Lind & Ponack

[57] ABSTRACT

A method for producing a high tensile strength and toughness bend pipe in which a heat treatment is done as a pretreatment prior to bending, and a tempering treatment is done, if necessary, after the bending, and the bend pipe produced by the present invention is useful for pipe line construction and shows excellent properties at low temperatures.

4 Claims, 1 Drawing Figure

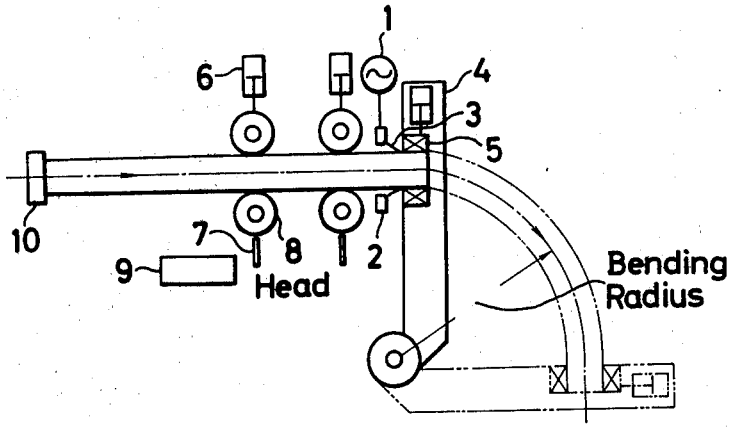
1
6
4
3
5
10
7
8
2
9
Head
Bending
Radius

METHOD FOR PRODUCING A HIGH TENSILE STRENGTH AND HIGH TOUGHNESS BEND PIPE

BACKGROUND OF THE INVENTION

1. Field of the Invention

The present invention relates to a method for producing a high tensile strength and high toughness metal bend pipe.

In recent years, a pipe-line transportation system has been increasingly used as mass-transportation means for liquid and gaseous fuels in view of economy and safety, and along this tendencies demands have been increasing for higher tensile strength and higher toughness of materials used in the pipe-line transportation system.

Particularly, bend pipes used in bent portions of the pipe-line are subjected to severer service conditions than the service conditions to which straight pipes are subjected, and stress imposed to the bend pipes is more complicated.

Description of Prior Art

As for a method for producing a bend pipe there has been conventionally known a mandrel method and a high frequency method. The mandrel method has been confronted with by problems such as shape defects, irregular pipe quality, and increased production cost, and the high frequency method has defects such as non-uniform mechanical properties between the bent portion and the non-bent portion. Thus, these conventional methods have been unsuccessful in providing a high tensile strength and high toughness bend pipe which can stand for severe service conditions at low temperatures.

Reasons for the failures of these conventional methods may be explained as below.

In the conventional mandrel method, after the steel pipe processing, the steel pipe is heated to austenitize the steel, subjected to bending by a mandrel, heated again to 900°C, and then quenched in water and tempered. Thus this method is susceptible to non-uniform quality due to the irregular quenching effect in the bent portion, as well as to shape deficiency.

Meanwhile, in the conventional high frequency method, after the steel pipe processing, the steel pipe is heated to austenitize the steel, then subjected to bending, and cooled in air. Thus, this method fails to give satisfactory strength and toughness as comparable with X-52 steel grades.

Further in order to obtain a bend pipe equal to or better than X-60 steel grades, the steel after the pipe processing is heated for austenitization, subjected to bending and the bent portion is quenched in water and tempered. Thus the heat cycle to which the non-bent portion is subjected is only the temper treatment, while the bent portion has a quenched and tempered structure, so that the steel pipe as a whole has a non-uniform quality, which causes stretcher reduction (SR) embrittlement in the bent portion. Further, the portion between the bent portion and the non-bent portion becomes a binary heated phase, a part of which is embrittled by the tempering treatment.

Also the welded portion during the pipe processing and the bent portion have different composition and structure due to the quenching and the tempering, thus causing embrittlement.

SUMMARY OF THE INVENTION

One of the objects of the present invention is to provide a low-cost bend pipe having a high strength not lower than X-60 of API standards as well as excellent low-temperature toughness, and uniform mechanical properties all through the bent and non-bent portions. The term "non-bent portion" used herein means any portion of the pipe which is not affected by working.

PREFERRED EMBODIMENTS OF THE INVENTION

The method according to the present invention may be done in the following embodiments.

1. Prior to the bending, the rough steel pipe is heated to an austenitization temperature, preferably to a temperature range of from $Ar_3$ to 1000°C, cooled down to a temperature ranging from 500°C to the room temperature, subjected to a local heating to not lower than the $A_3$ temperature followed by bending, and then cooled to the room temperature.

2. Prior to the bending, the rough steel pipe is heated to an austenitization temperature, preferably to a temperature range of from $Ar_3$ to 1000°C, subjected to a hardening treatment by cooling to a temperature ranging from 500°C to the room temperature with an average cooling rate of not less than 5°C/sec. between 800° and 500°C, to a local heating at a temperature not lower than the $A_3$ temperature followed by the bending and cooling to near the room temperature with an average cooling rate of not less than 5°C/sec. between 800° and 500°C, and finally subjected to tempering at a temperature ranging from 500° to 700°C.

3. Prior to the bending, the rough steel pipe is heated to an austenitization temperature, subjected to a hardening treatment by cooling the steel pipe to a temperature ranging from 500°C to the room temperature with an average cooling rate of not less than 5°C/sec. between 800° and 500°C, then to a tempering treatment at a temperature ranging from 500° to 700°C so as to prevent hydrogen-induced defects and failures due to bending stress as often seen during quenching in steel pipes remarkably susceptible to hardening, to a local heating at a temperature not lower than $A_3$ temperature followed by the bending and cooling to near the room temperature with an average cooling rate of not less than 5°C/sec. between 800° and 500°C and finally to a tempering treatment at a temperature equal to or lower than the preceeding quenching temperature but between 500° and 700°C.

The features of the present invention have been described hereinabove, and the most important feature of the present invention lies in that the heat treatment as described hereinafter is adopted as a pretreatment prior to the local heating followed by the bending.

Thus, during the cooling step to near the room temperature after the austenitization heating to refine the austenite grains, an appropriate cooling rate is selected so as to maintain the cooling condition almost same as the cooling conditions after the bending in order to obtain a uniform structure all through the bent portion and the nonbent portion, and in case of necessity, a tempering treatment is applied so as to improve strength and toughness under the as-bent condition and to obtain uniform quality.

When the above treatments are applied to a welded steel pipe and an electro seamed pipe, the toughness in the seam-welded portion and the butt-welded portion is recovered to a degree similar to that of the pipe body.

In this case, the strength and toughness as pretreated, namely prior to the bending, depends on the steel composition and the austenitizing condition during the heat-treatment as the pretreatment as well as the subsequent cooling rate and the tempering treatment conditions.

By applying the pretreatment as above to the rough steel pipe, and then the local heating at a temperature not lower than $A_3$ temperature followed by the bending, and if necessary by applying the tempering treatment, the non-bent portion is not affected by the heating during the bending working and thus maintains the high strength and toughness after the pretreatment. On the other hand, the bent portion is hardened appropriately during the cooling step after the bending working, and gives high strength and toughness as well as uniform quality by, if necessary, applying the tempering treatment between 500° and 700°C.

In this case, it is effective for assuring the strength of the non-bent portion to maintain the tempering temperature of the bent portion to a temperature equal to or lower than the tempering temperature before the pretreatment.

The embodiments (1), (2) and (3) of the present invention as set forth hereinbefore will be further explained.

According to the embodiment (1), there is no specific limitation in the cooling rate after the bending following the pretreatment and the local heating at a temperature not lower than $A_3$ temperature. This embodiment is applicable to production of a bend pipe having high hardenability as in case where it is necessary to make alloy addition to the steel pipe composition, such as when a large amount of alloying elements is added to give corrosion resistance which is strongly demanded other than strength and toughness as for a bend pipe used in slurry transportation, or applicable to production of a bend pipe having a relatively low strength as X-60 to 65 grade steels.

In case when the rough steel pipe is a welded pipe or an electroseamed pipe, the toughness of the welded portion in the non-bent portion is improved by this embodiment.

According to the second embodiment of the present invention, the cooling rate after the bending is limited to an average cooling rate of not less than 5°C/sec. from 800° to 500°C. This embodiment is effective to simplify the steel pipe composition by transforming the structure produced during the cooling into a bainite or martensite structure, and thus useful for producing a high tensile strength bend pipe having high strength and high toughness at a low production cost by minimizing the alloy addition. Thus, by saving the amount of alloy addition as much as possible so as to lower the production cost, and thus lowering the $C_{eq}$ value, the welding problem in spot which is very important for construction of the pipe line is considerably ameliorated.

When this embodiment is applied to a welded pipe, the toughness of the welded portion is recovered and very uniform mechanical properties are obtained just as in case of the embodiment (1).

The embodiment (3), which is an intermediate procedure between the embodiment (1) and the embodiment (2), is most useful for production of a bend pipe which is required to have high strength and toughness as well as other properties such as good corrosion resistance and has a wide application, where a moderate alloy addition is made and defects due to hydrogen during the pipe handling and failures due to the bending stress as seen in case of the pipes as-hardened can be eliminated.

Particularly, in order to produce a high-grade pipe consistently, the final tempering treatment is done at a temperature equal to or lower than that of the preceding tempering treatment but between 500° and 700°C so as to assure uniform quality throughout the non-bent portion and the bent portion.

As described above, the method of the present invention has its main feature in that the pretreatment is incorporated in the conventional pipe production process, and by this feature it has been made possible to produce a high tensile strength bend pipe having a high strength and toughness as well as uniform quality which have hitherto been impossible to obtain and defects of the conventional production process as confronted with in the production of a bend pipe having high strength and toughness better than the X-60 grade steel have been completely overcome by the present invention.

The present invention will be more clearly understood from the following examples referring to the attached drawing.

BRIEF DESCRIPTION OF THE DRAWING

FIG. 1 shows schematically a bending line, in which 1 is a high frequency current transformer, 2 is a high frequency heating coil, 3 is a cooler, 4 is an arm, 5 is a cramp, 6 is a hydraulic cylinder, 7 is a screw, 8 is a guide roller, 9 is a driving device and 10 is a tail stock.

The rough steel pipes having chemical compositions as shown in Table 1 were subjected to the heat treatments as shown in Table 2, subjected to bending under the conditions as shown in Table 3 and finally subjected to suitable post heat treatments. Table 4 shows conditions of the tempering treatment, and Table 5 shows the various properties of the steel pipes.

Steels No. 1 to No. 12 which were treated by the present invention showed excellent results strength equal to X-60 ~ X-90; toughness as expressed by a Charpy fracture transient temperature of lower than −40°C.

Steels No. 13 to No. 17 and No. 20 which were treated by a comparative conventional method revealed that it is difficult to satisfy X-60 in both the bent and non-bent portions even when a considerable large amount of alloying elements is added.

Steel No. 18 illustrates one example of the weld metal of a welded steel pipe, and shows better strength and thoughness as compared with steel No. 17 which was treated by a comparative method.

Similarly, steel No. 19 illustrates a welding heat-affected portion, and shows that the toughness in the non-bent portion is recovered to almost that of the pipe body and far better toughness can be obtained as compared with steel No. 20.

Table 1

| Steels | C | Si | Mn | P | S | Ni | Mo | Nb | V | Al | Plate Thickness mm | Pipe Diameter mm |
|---|---|---|---|---|---|---|---|---|---|---|---|---|
| | Chemical Composition of Rough Steel Pipes (wt %) | | | | | | | | | | | |
| A | 0.03 | 0.23 | 1.20 | 0.016 | 0.009 | — | — | — | — | 0.028 | 12.7 | 450 |
| B | 0.10 | 0.23 | 1.30 | 0.015 | 0.008 | — | — | — | — | 0.035 | 12.7 | 450 |
| C | 0.10 | 0.24 | 1.33 | 0.017 | 0.004 | — | — | 0.01 | 0.02 | 0.032 | 12.7 | 450 |
| D | 0.12 | 0.24 | 1.30 | 0.017 | 0.004 | — | — | 0.02 | 0.04 | 0.032 | 12.7 | 500 |
| E | 0.10 | 0.21 | 1.51 | 0.015 | 0.004 | 0.38 | 0.10 | 0.030 | — | 0.037 | 18.0 | 600 |
| F | 0.12 | 0.27 | 1.34 | 0.023 | 0.005 | 0.49 | 0.20 | — | — | 0.055 | 12.7 | 450 |
| G | 0.13 | 0.41 | 0.95 | 0.010 | 0.003 | 0.28 | 0.21 | 0.028 | — | 0.053 | 12.7 | 750 |

Table 2

| | Conditions of Pretreatments Heating Temperature °C | Holding Time sec. | Cooling Rate °Cl/sec. |
|---|---|---|---|
| 1 | 930 | 40 | 2 |
| 2 | 930 | 40 | 6 |
| 3 | 930 | 40 | 10 |
| 4 | 930 | 40 | 30 |
| 5 | 930 | 40 | 50 |

Table 3

| | Bending Conditions Working Temperature °C | Working Speed mm/sec. | Cooling Rate °C/sec. | Bending Radius | Remarks |
|---|---|---|---|---|---|
| I | 930 | 0.5 | 12 | 3 DR | Cooling in water |
| II | 930 | 1.0 | 25 | 4 DR | Cooling in water |

Table 3-continued

| | Bending Conditions Working Temperature °C | Working Speed mm/sec. | Cooling Rate °C/sec. | Bending Radius | Remarks |
|---|---|---|---|---|---|
| III | 930 | 2.0 | 40 | 5 DR | Cooling in water |
| VI | 930 | 1.0 | 2 | 5 DR | Forced Cooling in air |

Table 4

| | Conditions of Temper Treatment Temperature °C | Holding Time min. | Cooling |
|---|---|---|---|
| a | 520 | 30 | Air |
| b | 580 | 30 | Air |
| c | 620 | 30 | Air |

Table 5

| | | Properties of Steel Pipes: Production Condition: Rough Steel Pipe | Pre-treatment | Bending | Tempering | Bent Portion: Tensile Strength T.S. kg/mm | Y S kg/mm² | El % | Toughness vE-20 kg-m | vTrs °C | Hardness Hv 10 |
|---|---|---|---|---|---|---|---|---|---|---|---|
| 1 | Present Invention | F | 1 | VI | b | 60.2 | 46.9 | 37 | 7.3 | −48 | 198 |
| 2 | " | G | 1 | VI | b | 61.6 | 45.5 | 37 | 7.6 | −42 | 197 |
| 3 | " | B | 5 | III | a | 53.9 | 43.4 | 44 | 17.0 | −79 | 182 |
| 4 | " | C | 4 | III | b | 60.2 | 48.3 | 42 | 13.3 | −55 | 195 |
| 5 | " | D | 3 | II | b | 58.1 | 45.5 | 42 | 11.9 | −45 | 190 |
| 6 | " | F | 2 | I | c | 67.2 | 52.5 | 38 | 9.7 | −63 | 221 |
| 7 | " | B | 5 | III | a | 55.3 | 43.4 | 45 | 17.0 | −84 | 183 |
| 8 | " | O | 4 | II | b | 60.2 | 48.3 | 43 | 12.7 | −65 | 193 |
| 9 | " | O | 4 | I | b | 59.5 | 47.6 | 43 | 13.0 | −64 | 192 |
| 10 | " | E | 3 | I | c | 61.6 | 51.1 | 41 | 15.2 | −70 | 201 |
| 11 | " | F | 4 | I | c | 79.1 | 63.7 | 35 | 9.4 | −100 | 258 |
| 12 | " | G | 3 | I | c | 77.7 | 61.6 | 37 | 18.4 | −69 | 247 |
| 13 | Comparative | C | — | I | — | 58.1 | 38.5 | 42 | 9.7 | −22 | 196 |
| 14 | " | D | — | VI | — | 47.6 | 36.4 | 43 | 8.6 | −43 | 160 |
| 15 | " | E | — | VI | — | 53.9 | 39.2 | 38 | 9.7 | −55 | 174 |
| 16 | " | H | — | VI | — | 51.1 | 37.8 | 29 | 11.5 | −85 | 163 |
| 17 | " | D | — | VI | — | 46.2 | — | 30 | 11.8 | −30 | 155 |
| 18 | Present Invention | D | 4 | II | b | 60.9 | — | 31 | 16.0 | −52 | 172 |
| 19 | " | D | 4 | II | b | — | — | — | 12.3 | −72 | 190 |
| 20 | Comparative | D | — | VI | — | — | — | — | 11.9 | −62 | 188 |

| | | Non-bent Portion: Tensile Strength T.S kg/mm² | Y S kg/mm² | El % | Toughness vE-20 kg-m | vTrs °C | Hardness Hv 10 | Remarks | Tempering Temp. in Pretreatment |
|---|---|---|---|---|---|---|---|---|---|
| 1 | Present Invention | 60.9 | 46.2 | 35 | 8.0 | −45 | 201 | Embodiment 1) | |
| 2 | " | 63.0 | 46.2 | 34 | 7.5 | −43 | 203 | " | |
| 3 | " | 56.0 | 44.1 | 46 | 15.9 | −77 | 186 | Embodiment 2) | |
| 4 | " | 61.6 | 46.9 | 41 | 10.8 | −60 | 202 | " | |
| 5 | " | 56.7 | 43.4 | 43 | 10.0 | −43 | 185 | " | |
| 6 | " | 68.6 | 51.1 | 40 | 9.5 | −63 | 193 | " | |
| 7 | " | 54.6 | 44.8 | 46 | 16.6 | −75 | 184 | Embodiment 3), | 620°C |
| 8 | " | 63.0 | 49.7 | 42 | 12.3 | −65 | 201 | " | 660°C |
| 9 | " | 62.3 | 46.9 | 44 | 13.5 | −72 | 198 | " | 680°C |
| 10 | " | 58.1 | 49.0 | 42 | 14.0 | −64 | 197 | " | 620°C |
| 11 | " | 77.0 | 64.4 | 33 | 8.8 | −100 | 251 | " | 640°C |
| 12 | " | 74.9 | 59.5 | 35 | 16.6 | −62 | 243 | " | 600°C |
| 13 | Comparative | 50.4 | 34.3 | 42 | 6.1 | −10 | 164 | | |

Table 5-continued

| | | | | | Properties of Steel Pipes | | | | |
|---|---|---|---|---|---|---|---|---|---|
| 14 | " | 52.5 | 47.6 | 40 | 6.8 | −23 | 171 | | |
| 15 | " | 57.4 | 47.6 | 41 | 10.1 | −52 | 177 | After rolling, | |
| 16 | " | 51.1 | 39.2 | 28 | 11.8 | −78 | 161 | normalizing-tempering | |
| 17 | " | 50.4 | — | 28 | 6.6 | −12 | 163 | Weld metal | |
| 18 | Present Inv. | 59.5 | — | 30 | 14.7 | −46 | 74 | Embodiment 3) | Weld metal |
| 19 | " | — | — | — | 12.6 | −63 | 188 | " | Heat-affected |
| 20 | Comparative | — | — | — | 4.1 | −10 | 186 | Heat-affected Portion | Portion |

What is claimed is:

1. A method for producing a high tensile strength and high toughness bend pipe which comprises heating a rough steel pipe to an austenitization temperature prior to bending, cooling the steel pipe to a temperature ranging from 500°C to near the room temperature, locally heating the steel pipe at a temperature not lower than its $A_3$ temperature, bending the steel pipe, and cooling the steel pipe to the room temperature.

2. A method according to claim 1, in which the austenitization temperature ranges from $Ar_3$ point to 1000°C.

3. A method according to claim 1, in which the cooling prior to the bending is done at an average cooling rate of not less than 5°C/sec. between 800° and 500°C, and the cooling subsequent to the bending is done at an average cooling rate of not less than 5°C/sec. between 800° and 500°C, and the steel pipe is tempered at a temperature between 500° and 700°C.

4. A method according to claim 3, in which the steel pipe is subjected to a tempering treatment between 500° and 700°C prior to the local heating.

* * * * *